US011168683B2

(12) United States Patent
Gottfried et al.

(10) Patent No.: US 11,168,683 B2
(45) Date of Patent: Nov. 9, 2021

(54) PRESSURE BALANCING SYSTEM FOR A FLUID PUMP

(71) Applicant: Exponential Technologies, Inc., Calgary (CA)

(72) Inventors: Kristjan Gottfried, Port Alberni (CA); Erik Farrell, Calgary (CA); Michael Sereda-Mohr, Calgary (CA)

(73) Assignee: Exponential Technologies, Inc., Calgary (CA)

( * ) Notice: Subject to any disclaimer, the term of this patent is extended or adjusted under 35 U.S.C. 154(b) by 0 days.

(21) Appl. No.: 16/817,049

(22) Filed: Mar. 12, 2020

(65) Prior Publication Data

US 2020/0291935 A1 Sep. 17, 2020

Related U.S. Application Data

(60) Provisional application No. 62/818,633, filed on Mar. 14, 2019.

(51) Int. Cl.

| | |
|---|---|
| ***F04C 3/06*** | (2006.01) |
| ***F04C 29/00*** | (2006.01) |
| ***F04C 15/00*** | (2006.01) |

(52) U.S. Cl.

CPC ..... *F04C 3/06* (2013.01); *F04C 15/0003* (2013.01); *F04C 15/0046* (2013.01); (Continued)

(58) Field of Classification Search

CPC ..... F04C 15/0003; F04C 3/06

See application file for complete search history.

(56) References Cited

U.S. PATENT DOCUMENTS

| | | | |
|---|---|---|---|
| 32,372 | A | 5/1861 | Jones |
| 351,129 | A | 10/1886 | Salomo |

(Continued)

FOREIGN PATENT DOCUMENTS

| | | | |
|---|---|---|---|
| AU | 2014202553 | A1 | 6/2014 |
| AU | 2012245033 | B2 | 5/2016 |

(Continued)

OTHER PUBLICATIONS

Figliolini, Algorithms for Involute and Octoidal Bevel-Gear Generation, ASME, vol. 127, Jul. 2005, 9 pages.

(Continued)

*Primary Examiner* — Mary Davis

(74) *Attorney, Agent, or Firm* — Schacht Law Office, Inc.; Dwayne Rogge

(57) ABSTRACT

A pressure balancing system for a pump. In one example, the pressure balancing system has: a housing; a first rotor a first shaft, a first face surface; a second rotor, a second face surface adjacent the first face surface of the first rotor; the face of the first rotor, the face of the second rotor, and an inner surface of the housing forming at least one working fluid chamber; an annular ring fitted around a shaft, adjacent a first pressure chamber having a fluid connection through the housing; the annular ring configured to bias the first rotor toward the second rotor when fluid is supplied under pressure to the first pressure chamber; a fluid conduit is configured to convey fluid to a pressure chamber between the housing and the annular ring to bias the annular ring thus biasing the first rotor toward the second rotor.

7 Claims, 4 Drawing Sheets

(52) U.S. Cl.
CPC ..... *F04C 29/0021* (2013.01); *F04C 2240/50* (2013.01); *F04C 2240/60* (2013.01)

(56) References Cited

U.S. PATENT DOCUMENTS

| | | | |
|---|---|---|---|
| 815,485 | A | 3/1906 | Stewart |
| 855,106 | A | 5/1907 | Hensel |
| 914,155 | A | 3/1909 | Mills et al. |
| 991,576 | A | 5/1911 | White, Jr. |
| 1,088,174 | A | 2/1914 | Henri |
| 1,285,870 | A | 11/1918 | Erik |
| 1,295,231 | A | 2/1919 | Stewart et al. |
| 1,379,653 | A | 5/1921 | Shoemaker |
| 1,647,167 | A | 11/1927 | Wildhaber |
| 1,748,813 | A | 2/1930 | Wildhaber |
| 2,101,051 | A | 12/1937 | Cuny |
| 2,101,428 | A | 12/1937 | Cuny |
| 2,242,058 | A | 5/1941 | Cuny |
| 2,280,845 | A | 4/1942 | Parker |
| 2,397,003 | A | 3/1946 | Hambelton |
| 2,431,817 | A | 12/1947 | Mann |
| 2,551,735 | A | 5/1951 | Goff |
| 2,578,763 | A | 12/1951 | Trbojevich |
| 2,578,764 | A | 12/1951 | Trbojevich |
| 2,582,413 | A | 1/1952 | Clark |
| 2,828,695 | A | 4/1958 | Wilmott |
| 3,101,700 | A | 8/1963 | Bowdish |
| 3,103,126 | A | 9/1963 | Textrom |
| 3,106,912 | A | 10/1963 | Kahlert |
| 3,141,313 | A | 7/1964 | Brickett et al. |
| 3,156,222 | A | 11/1964 | Miller, Jr. |
| 3,236,186 | A | 2/1966 | Wildhaber |
| 3,272,130 | A | 9/1966 | Mosbacher |
| 3,273,341 | A | 9/1966 | Ernest |
| 3,384,425 | A | 5/1968 | Maurice |
| 3,508,430 | A | 4/1970 | Edmondson |
| 3,653,790 | A | 4/1972 | Richard |
| 3,769,944 | A | 11/1973 | Raymond |
| 3,773,442 | A | 11/1973 | Mitchell et al. |
| 3,816,038 | A | 6/1974 | Berry |
| 3,816,039 | A | 6/1974 | Berry |
| 3,820,923 | A | 6/1974 | Zweifel |
| 3,845,562 | A | 11/1974 | Dallas |
| 3,856,440 | A | 12/1974 | Wildhaber |
| 3,884,050 | A | 5/1975 | Borcuk |
| 3,911,759 | A | 10/1975 | Tanaka et al. |
| 3,927,899 | A | 12/1975 | Bough |
| 3,971,603 | A | 7/1976 | Bjerk |
| 3,982,861 | A | 9/1976 | Gibson |
| 4,036,566 | A | 7/1977 | Konopeskas |
| 4,078,809 | A | 3/1978 | Garrick et al. |
| 4,180,188 | A | 12/1979 | Akao et al. |
| 4,252,511 | A | 2/1981 | Bowdish |
| 4,373,881 | A | 2/1983 | Matsushita |
| 4,478,553 | A | 10/1984 | Leibowitz et al. |
| 4,579,351 | A | 4/1986 | Daffron |
| 4,642,046 | A | 2/1987 | Saito et al. |
| 4,702,206 | A | 10/1987 | Harries |
| 4,721,445 | A | 1/1988 | Hoffmann |
| 4,799,694 | A | 1/1989 | Brauers |
| 4,799,870 | A | 1/1989 | McMaster |
| 4,872,815 | A | 10/1989 | Takai |
| 4,969,371 | A | 11/1990 | Allen |
| 4,984,432 | A | 1/1991 | Corey |
| 5,031,922 | A | 7/1991 | Heydrich |
| 5,042,823 | A | 8/1991 | Mackay et al. |
| 5,056,314 | A | 10/1991 | Paul et al. |
| 5,108,116 | A | 4/1992 | Johnson et al. |
| 5,171,138 | A | 12/1992 | Forrest |
| 5,281,032 | A | 1/1994 | Slocum |
| 5,427,068 | A | 6/1995 | Palmer |
| 5,513,969 | A | 5/1996 | Arnold |
| 5,589,671 | A | 12/1996 | Hackbarth et al. |
| 5,613,914 | A | 3/1997 | Gleasman et al. |
| 5,674,053 | A | 10/1997 | Paul et al. |
| 5,695,201 | A | 12/1997 | Wheeler |
| 5,709,388 | A | 1/1998 | Skinner et al. |
| 5,755,196 | A | 5/1998 | Klassen |
| 5,908,195 | A | 6/1999 | Sharrer |
| 5,941,685 | A | 8/1999 | Bagepalli et al. |
| 5,964,467 | A | 10/1999 | Hirata |
| 5,971,400 | A | 10/1999 | Turnquist et al. |
| 6,032,636 | A | 3/2000 | Kajino |
| 6,036,463 | A | 3/2000 | Klassen |
| 6,062,018 | A | 5/2000 | Bussing |
| 6,146,120 | A | 11/2000 | Harms |
| 6,161,839 | A | 12/2000 | Walton et al. |
| 6,196,550 | B1 | 3/2001 | Arora et al. |
| 6,226,986 | B1 | 5/2001 | Driver et al. |
| 6,239,361 | B1 | 5/2001 | Snaper |
| 6,336,389 | B1 | 1/2002 | English et al. |
| 6,343,792 | B1 | 2/2002 | Shinohara et al. |
| 6,364,316 | B1 | 4/2002 | Arora |
| 6,431,550 | B1 | 8/2002 | Tong |
| 6,457,450 | B1 | 10/2002 | Luzhkov |
| 6,481,410 | B1 | 11/2002 | Ogilvie |
| 6,494,698 | B2 | 12/2002 | Arnold |
| 6,497,564 | B2 | 12/2002 | Klassen |
| 6,565,094 | B2 | 5/2003 | Wright et al. |
| 6,585,270 | B2 | 7/2003 | Tong |
| 6,612,821 | B1 | 9/2003 | Maria et al. |
| 6,634,873 | B2 | 10/2003 | Klassen |
| 6,655,696 | B1 | 12/2003 | Fang et al. |
| 6,694,858 | B2 | 2/2004 | Grimes |
| 6,695,316 | B2 | 2/2004 | Popa et al. |
| 6,705,161 | B1 | 3/2004 | Klassen |
| 6,736,401 | B2 | 5/2004 | Chung et al. |
| 6,739,852 | B1 | 5/2004 | Klassen |
| 6,769,889 | B1 | 8/2004 | Raney et al. |
| 6,887,057 | B2 | 5/2005 | Klassen |
| 6,923,055 | B2 | 8/2005 | Klassen |
| 6,932,349 | B2 | 8/2005 | Coppola |
| 6,991,235 | B2 | 1/2006 | Ebert et al. |
| 7,182,345 | B2 | 2/2007 | Justak |
| 7,275,920 | B2 | 10/2007 | Arnold |
| 7,340,903 | B2 | 3/2008 | Lu et al. |
| 7,351,047 | B2 | 4/2008 | Kawakami et al. |
| 7,410,173 | B2 | 8/2008 | Justak |
| 7,510,086 | B2 | 3/2009 | Henssler et al. |
| 7,538,464 | B2 | 5/2009 | Hemmi et al. |
| 7,604,239 | B2 | 10/2009 | Chitren et al. |
| 7,721,523 | B2 | 5/2010 | Tangirala et al. |
| 7,726,660 | B2 | 6/2010 | Datta |
| 7,726,940 | B2 | 6/2010 | Snowsill et al. |
| 7,758,334 | B2 | 7/2010 | Shimo et al. |
| 7,806,410 | B2 | 10/2010 | El-Aini et al. |
| 8,562,318 | B1 | 10/2013 | Gottfried et al. |
| 8,602,758 | B2 | 12/2013 | Juan et al. |
| 8,689,766 | B2 | 4/2014 | Oledzki |
| 8,834,140 | B2 | 9/2014 | Arnold et al. |
| 8,887,592 | B2 | 11/2014 | Patterson et al. |
| 9,115,646 | B2 | 8/2015 | Patterson et al. |
| 9,121,275 | B2 | 9/2015 | Patterson et al. |
| 9,316,102 | B2 | 4/2016 | Patterson et al. |
| 9,359,973 | B2 | 6/2016 | Farshchian et al. |
| 9,447,688 | B2 | 9/2016 | Juan et al. |
| 9,777,729 | B2 | 10/2017 | Juan et al. |
| 9,856,878 | B2 | 1/2018 | Santos et al. |
| 9,874,097 | B2 | 1/2018 | Patterson et al. |
| 10,337,328 | B2 | 7/2019 | Juan et al. |
| 10,975,869 | B2 | 4/2021 | Juan et al. |
| 2001/0031215 | A1 | 10/2001 | Klassen |
| 2001/0055992 | A1 | 12/2001 | Basstein |
| 2002/0020171 | A1 | 2/2002 | Driver |
| 2002/0037228 | A1 | 3/2002 | Arnold |
| 2002/0043238 | A1 | 4/2002 | McMaster et al. |
| 2002/0157636 | A1 | 10/2002 | Klassen |
| 2003/0025274 | A1 | 2/2003 | Allan et al. |
| 2003/0111797 | A1 | 6/2003 | Chung et al. |
| 2003/0122266 | A1 | 7/2003 | Nau et al. |
| 2003/0209221 | A1 | 11/2003 | Klassen |
| 2003/0231971 | A1 | 12/2003 | Klassen |
| 2004/0000760 | A1 | 1/2004 | Aksit et al. |
| 2004/0113367 | A1 | 6/2004 | Martins et al. |

(56) References Cited

U.S. PATENT DOCUMENTS

| | | | |
|---|---|---|---|
| 2004/0155410 | A1 | 8/2004 | Proctor et al. |
| 2004/0211387 | A1 | 10/2004 | Morgado |
| 2005/0098957 | A1 | 5/2005 | Goss et al. |
| 2005/0098958 | A1 | 5/2005 | Ebert et al. |
| 2005/0276714 | A1 | 12/2005 | Klassen |
| 2006/0125190 | A1 | 6/2006 | Addis |
| 2006/0214378 | A1 | 9/2006 | Zheng |
| 2007/0063448 | A1 | 3/2007 | Kowalczyk et al. |
| 2007/0096397 | A1 | 5/2007 | Justak |
| 2007/0151227 | A1 | 7/2007 | Worrell |
| 2007/0180810 | A1 | 8/2007 | Chapin et al. |
| 2007/0207049 | A1 | 9/2007 | Ooi et al. |
| 2007/0245712 | A1 | 10/2007 | Shimo et al. |
| 2007/0252336 | A1 | 11/2007 | Grabeldinger et al. |
| 2007/0253851 | A1 | 11/2007 | Arnold |
| 2007/0274853 | A1 | 11/2007 | Merendeiro et al. |
| 2008/0008579 | A1 | 1/2008 | Mikulec |
| 2008/0029968 | A1 | 2/2008 | Addis |
| 2008/0107525 | A1 | 5/2008 | Adis et al. |
| 2008/0122183 | A1 | 5/2008 | Braun et al. |
| 2008/0136112 | A1 | 6/2008 | Addis |
| 2009/0194948 | A1 | 8/2009 | Wirt |
| 2010/0021247 | A1 | 1/2010 | Aldred et al. |
| 2010/0074786 | A1 | 3/2010 | Juan et al. |
| 2010/0122685 | A1 | 5/2010 | Oledzki |
| 2010/0133834 | A1 | 6/2010 | Nimberger |
| 2010/0215531 | A1 | 8/2010 | Arnold |
| 2011/0121519 | A1 | 5/2011 | Justak |
| 2011/0204064 | A1 | 8/2011 | Crane et al. |
| 2011/0311351 | A1 | 12/2011 | Patterson et al. |
| 2012/0121411 | A1 | 5/2012 | Endo et al. |
| 2012/0299248 | A1 | 11/2012 | Cordiner et al. |
| 2012/0308367 | A1 | 12/2012 | Luczak |
| 2013/0200634 | A1 | 8/2013 | Patterson et al. |
| 2013/0281220 | A1 | 10/2013 | Flow et al. |
| 2015/0260184 | A1 | 9/2015 | Farrell et al. |
| 2015/0361794 | A1 | 12/2015 | Patterson et al. |
| 2017/0130583 | A1 | 5/2017 | Juan et al. |
| 2020/0291935 | A1 | 9/2020 | Gottfried et al. |

FOREIGN PATENT DOCUMENTS

| | | | |
|---|---|---|---|
| AU | 2012357567 | B2 | 3/2017 |
| CA | 1080990 | A | 7/1980 |
| CA | 2069607 | A1 | 11/1993 |
| CA | 2491298 | A1 | 6/2006 |
| CA | 2735567 | A1 | 3/2010 |
| CA | 2803250 | A1 | 12/2011 |
| CA | 2807402 | A1 | 2/2012 |
| CA | 2833593 | A1 | 10/2012 |
| CA | 2859772 | A1 | 6/2013 |
| CA | 2903906 | A1 | 9/2014 |
| CA | 2759433 | C | 7/2017 |
| CA | 2735567 | C | 8/2018 |
| CN | 201354837 | Y | 12/2009 |
| CN | 103649584 | A | 3/2014 |
| CN | 102203386 | B | 9/2014 |
| CN | 103052762 | A | 7/2016 |
| DE | 1551081 | A1 | 4/1970 |
| DE | 2639760 | A1 | 3/1978 |
| DE | 3221994 | A1 | 12/1983 |
| EP | 1366289 | B1 | 4/2007 |
| EP | 2699821 | B1 | 3/2017 |
| FR | 916277 | A | 8/1946 |
| GB | 190205686 | A | 11/1902 |
| GB | 805370 | A | 12/1958 |
| GB | 1099085 | A | 1/1968 |
| GB | 1269063 | A | 3/1972 |
| IT | 268459 | A1 | 1/1933 |
| JP | 4329764 | | 12/1943 |
| JP | 52014904 | | 2/1977 |
| JP | 61112860 | A | 3/1986 |
| JP | 2001355401 | A | 12/2001 |
| JP | 2002021979 | A | 1/2002 |
| JP | 2005048903 | A | 2/2005 |
| JP | 3657530 | B2 | 6/2005 |
| JP | 2006250382 | A | 9/2006 |
| JP | 3853355 | B2 | 12/2006 |
| JP | 2014517187 | A | 7/2014 |
| JP | 5572683 | B2 | 8/2014 |
| JP | 5723278 | B2 | 5/2015 |
| JP | 5913298 | B2 | 5/2016 |
| JP | 5991719 | B2 | 9/2016 |
| JP | 6193213 | B2 | 9/2017 |
| KR | 20130124283 | A | 11/2013 |
| KR | 101589966 | B1 | 2/2016 |
| KR | 101645266 | B1 | 8/2016 |
| KR | 101916493 | B1 | 11/2018 |
| MX | 2011002829 | A | 4/2011 |
| MX | 344134 | B | 12/2016 |
| MX | 359421 | B | 9/2018 |
| PH | 12011500566 | | 6/2014 |
| RU | 2156862 | C1 | 9/2000 |
| RU | 2549007 | C2 | 4/2015 |
| RU | 2575514 | C2 | 2/2016 |
| RU | 2014128985 | A | 2/2016 |
| RU | 2619153 | C2 | 5/2017 |
| RU | 2015108412 | A3 | 10/2018 |
| SG | 194353 | A1 | 11/2013 |
| WO | 9533936 | A1 | 12/1995 |
| WO | 9628641 | A1 | 9/1996 |
| WO | 9911944 | A1 | 3/1999 |
| WO | 9961753 | A1 | 12/1999 |
| WO | 2007099768 | A1 | 9/2007 |
| WO | 2007112442 | A2 | 10/2007 |
| WO | 2010031173 | A1 | 3/2010 |
| WO | 2010047602 | A1 | 4/2010 |
| WO | 2010139065 | A1 | 12/2010 |
| WO | 2011025160 | A2 | 3/2011 |
| WO | 2011156924 | A1 | 12/2011 |
| WO | 2013091098 | A1 | 6/2013 |
| WO | 2017198720 | A1 | 11/2017 |
| WO | 2019113704 | A1 | 6/2019 |
| WO | 2020181387 | A1 | 9/2020 |

OTHER PUBLICATIONS

George, Granco Positive Displacement Pump, Plant Engineering Magazine, Dec. 10, 1981, 9 pages.

Kapelevich, "Geometry and Design of Involute Spur Gears With Asymmetric Teeth", Apr. 27, 1998, 14 pages.

Kopscisk, "Application and Operating History of Moderate-Speed API 618 Reciprocating Compressors," Proceedings for the Thirty-Third Turbomachinery Symposium, 2004, 10 pages.

NASA, Pressure-Balanced, Low-Hysteresis Finger Seal Developed and Tested. Updated Apr. 24, 2000. http://www.grc.nasa.gov/WWW/RT/RT1999/50001/~proctor.html.

Park et al., "The spherical Involute bevel gear: its geometry, kinematic behavior and standardization", Journal of Mechanical Science and Technology 25 (4) (2011) 1023-1034, Manuscript Received Dec. 11, 2009.

Pillis, Basics of Operation and Application of Oil Flooded Rotary Screw Compressors, 1999, 10 pages.

Sage Energy Corporation, "Screw Compressors Misconception or Reality," www.drivetrainpower.com, Apr. 27, 2013, 25 pages.

Wankel, Felix, Rotary Piston Machines, Jan. 1, 1965, 16 pages.

Wikipedia, Gear Coupling, http://en.wikipedia.org/wiki/Gear_coupling, May 4, 2011, 1 page.

ISA, ISR, PCTCA2020050338, dated May 28, 2020, 3 pages.

PRESSURE BALANCING SYSTEM FOR A FLUID PUMP

RELATED APPLICATIONS

This application claims priority of U.S. Provisional Patent Application Ser. No. 62/818,633 filed on Mar. 14, 2019 incorporated herein by reference.

BACKGROUND OF THE DISCLOSURE

Field of the Disclosure

This disclosure relates to the field of fluid pumps, compressors, expanders, having a plurality of rotors on separate axes of rotation, where the axes of the rotors are non-linear and intersect. The modification herein being an apparatus configured to provide a fluid bearing to offset pressure loads within the chambers between facing surfaces of the rotors.

BRIEF SUMMARY OF THE DISCLOSURE

Disclosed herein are several examples of a pressure balancing system for a pump. In one example, the pressure balancing system comprises: a housing; a first rotor within the housing having a first axis of rotation, a first shaft, a first face surface; a second rotor having an axis of rotation, a second face surface adjacent the first face surface of the first rotor; the face of the first rotor, the face of the second rotor, and an inner surface of the housing forming at least one working fluid chamber; an annular ring fitted around a shaft, adjacent a first pressure chamber having a fluid connection through the housing; the annular ring configured to bias the first rotor toward the second rotor when fluid is supplied under pressure to the first pressure chamber; a fluid conduit is configured to convey fluid to a pressure chamber between the housing and the annular ring to bias the annular ring against a radial extension of the first shaft thus biasing the first rotor toward the second rotor.

DETAILED DESCRIPTION OF THE DISCLOSURE

This disclosure describes several examples of improvements to pumps, compressors, expanders, of the positive displacement configuration. In positive displacement devices, a plurality of rotors (first rotor and second rotor) have facing surfaces comprising mounds and valleys forming chambers therebetween. As the rotors turn about their offset axes, the volume of these chambers changes as the rotors move to a position where the mounds of one rotor displaces the volume of a rotor valley of the opposing rotor. Several examples of such positive displacement pumps of previous configurations are shown in the examples of U.S. Pat. No. 8,602,758, as well as the examples shown in U.S. Pat. No. 9,777,729 each incorporated herein by reference. Each of these references including technical features known to those of ordinary skill in the art.

Figure 1:
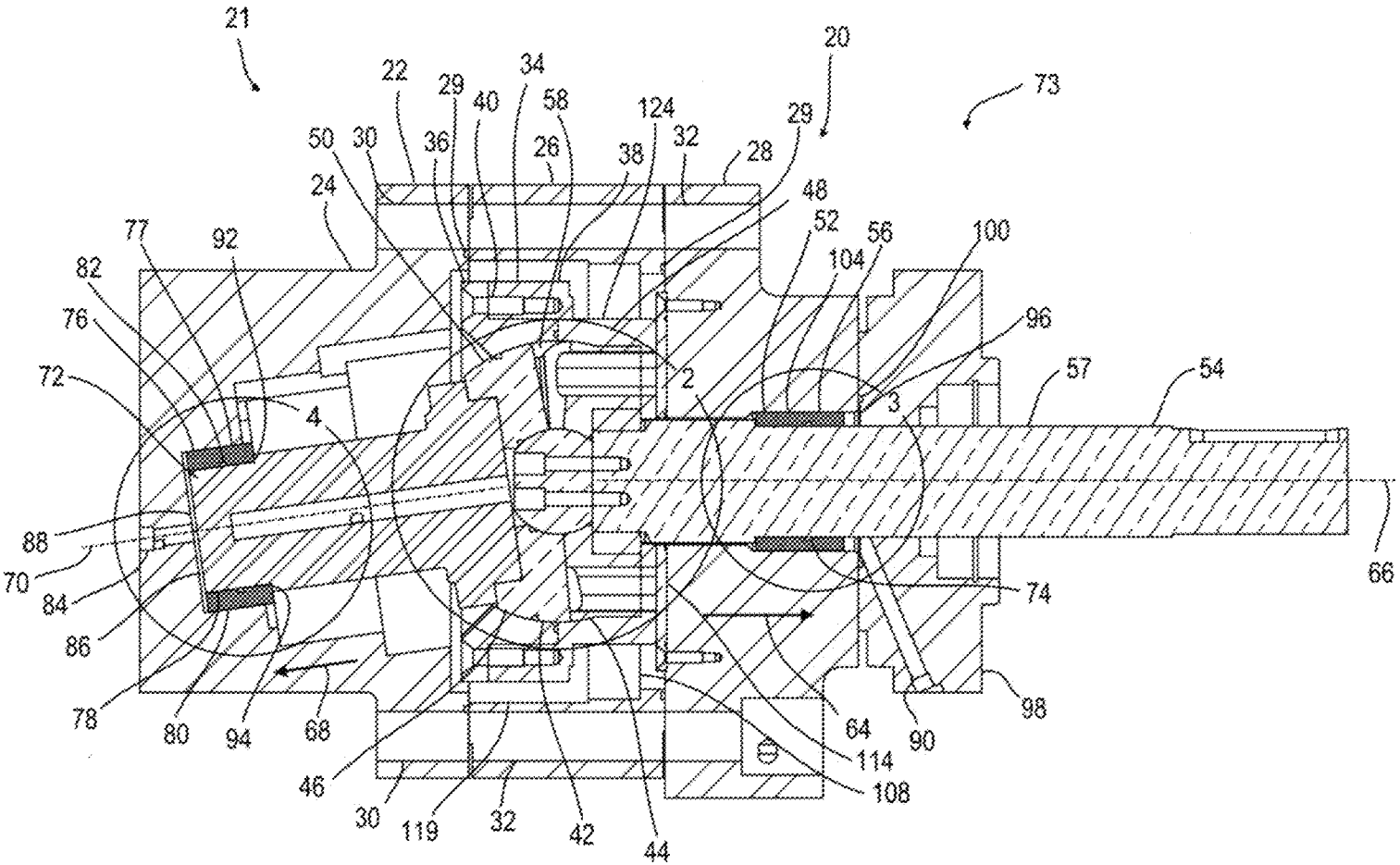
FIG. 1 is a cross-sectional side view of one example of the disclosed pressure balancing system used in a pump.

Shown in FIG. 1 is one example of the disclosed pressure balancing system used with a pump 20. The pump 20 shown in cross section. This view revealing the internal components of the pump including the rotors, shafts, bearings, seals, etc.

In one example, the moving components of the pump 20 (including the rotors) are contained within a housing 21 including an outer housing 22 which contains the moving components, forms fluid conduits external of the pump 20, and provides a structure to hold position of the internal and external components.

To ease assembly and repair of the pump 20, the outer housing 22 may comprise several connected housing components, in one example, including components 24, 26, 28. These components 24, 26, 28 may be connected to each other by mechanical fasteners such as screws, pins, bolts, welding, etc. or may be combined during a casting or other manufacturing step. In one example as shown, the outer housing 22 comprises outer housing components 24, 26, 28 which may be fastened together via fasteners such as bolts, or screws 30 passing through surfaces defining voids 32 or may be combined during a casting or other manufacturing step. Combinations of these components may be formed of unitary constructions. As shown in the drawings the components are split cross-axially. In another example, the components may also be split axially rather than radially as shown. Seals 29 may be used between these outer housing components 24, 26, 28 to reduce or elimination leakage therebetween.

In the example shown, the housing 21 also comprises an inner housing 34 is positioned within the outer housing 22 and configured to rotate therein relative to the outer housing 22. In this example, the inner housing 34 comprises inner housing components 36, 38 connected by way of fasteners 40. The inner housing 34 of this example rotates within the outer housing 22 with one of the rotors. In this example the inner housing 34 rotates with the first rotor 44. The inner housing 34 rotates with the first rotor 44 to eliminate relative movement between the first rotor 44 and the inner housing 34 as well as to reduce relative movement (e.g. rotation) between the second rotor 46 and the inner housing 34. This reduction in relative rotation reduces wear of seal 45. Seal 45 reduces or eliminates leakage between the second rotor 46 and the inner housing 34.

In the example shown, the inner housing 34 comprises a frusto-spherical inner surface 42 conforming to and immediately adjacent the outer surfaces 48/50 of the rotors. The frusto-spherical surface 42 of the inner housing 34 provides a seal surface for the seal 45. The second rotor 46 of one example has a frusto-spherical radially outer surface 50 adjacent the surface 42. In another example, the radially outer surface 48 of the first rotor 44 is not frusto-spherical. In such an example, the first rotor 44 may be formed as a part of the inner housing 34 or it may be a separate component which is fixed to the inner housing 34.

The term frusto-spherical used in this disclosure denotes a shape which is a portion of a sphere. The term is not necessarily a portion of a sphere as cut by a plurality of parallel planes as is one common definition. In the example of the second rotor 46, the radially outer surface 50 is in part spherical. Conceptually, the radially outward edges/surfaces of the valleys of the contact face of the second rotor 46 are the same spherical dimensions as the surface 50. This surface 50 in one example is only slightly smaller than the radial dimension of the inner surface 42. In one example these surfaces forming a fluid seal or partial fluid seal.

The valleys of the opposing rotor faces cooperate with the mounds of the opposing rotor to form the working fluid chambers. These valleys also provide space for the mounds of the opposing rotor 46. As the rotors rotate, this cooperation results in reducing and increasing the volume of the working fluid chambers. In one example, both rotors 44/46 revolve within the outer housing 22 about axes that are offset and intersecting. Thus, the chambers increase and decrease in size as the rotors 44/46 revolve. To facilitate operation the porting locations (inlet/outlet) may be positioned to maximize efficiency in pumping, compressing, or expanding of the working fluid flowing through the pump 20.

As the working fluid creates pressure in the chamber 58, the contact faces 60/62 are forced away from each other in directions shown by arrows 64/68. The arrow 64 aligned with (parallel to) the axis 66 of the drive shaft 55, wherein the axis 66 is also the axis of the first rotor 44. Force arrow 68 aligned with (parallel to) axis 70 of the second (floating) shaft 72. These axial forces reduce efficiency of the pump 20 in operation if not efficiently countered. Prior known mechanical thrust bearings are utilized on surfaces substantially normal to the axes of the shafts 54/72 and in contact with the housing 22. Such mechanical thrust bearings comprise rigid components which cause heat, sound, friction, and are often replaced due to wear and damage.

The pressure balancing system 73 disclosed herein is specifically configured to offset, counter, and balance these forces 64/68 more efficiently than other known devices.

Figure 2:
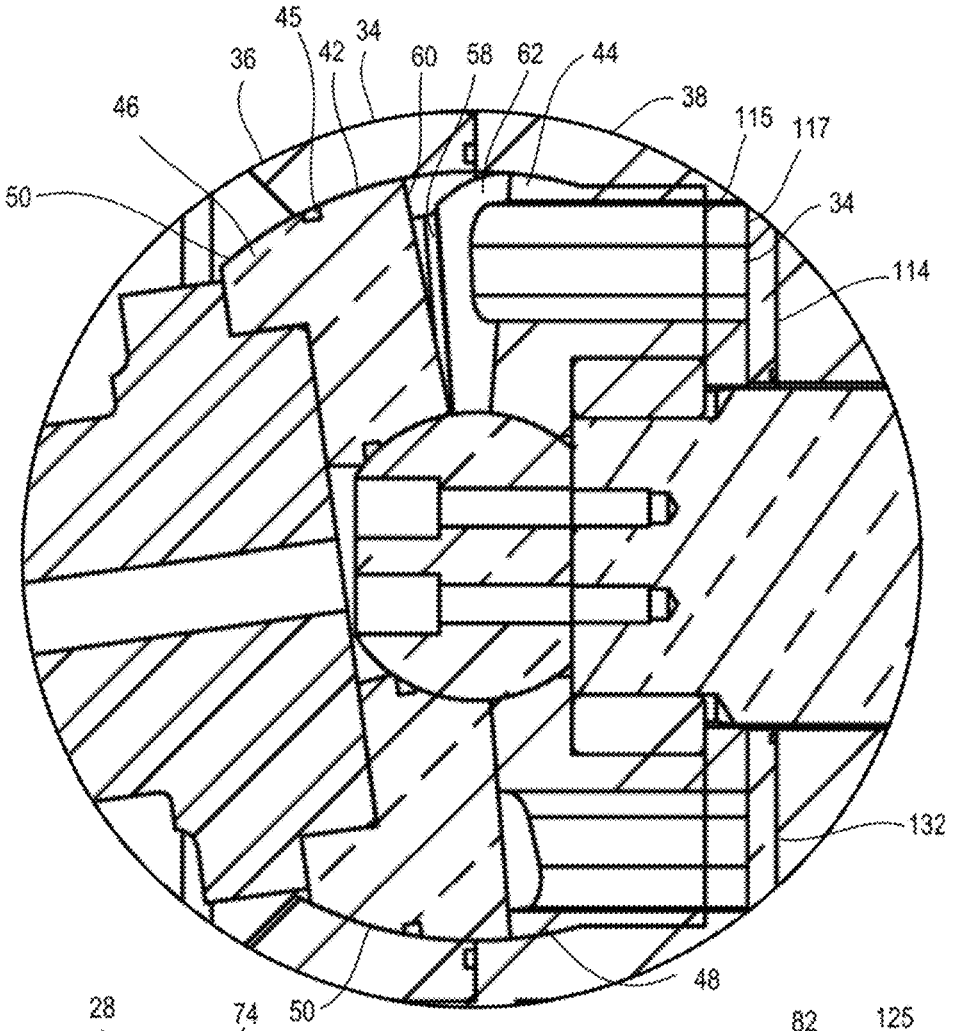
FIG. 2 is an enlarged view of the region 2 of FIG. 1.
Figure 5:
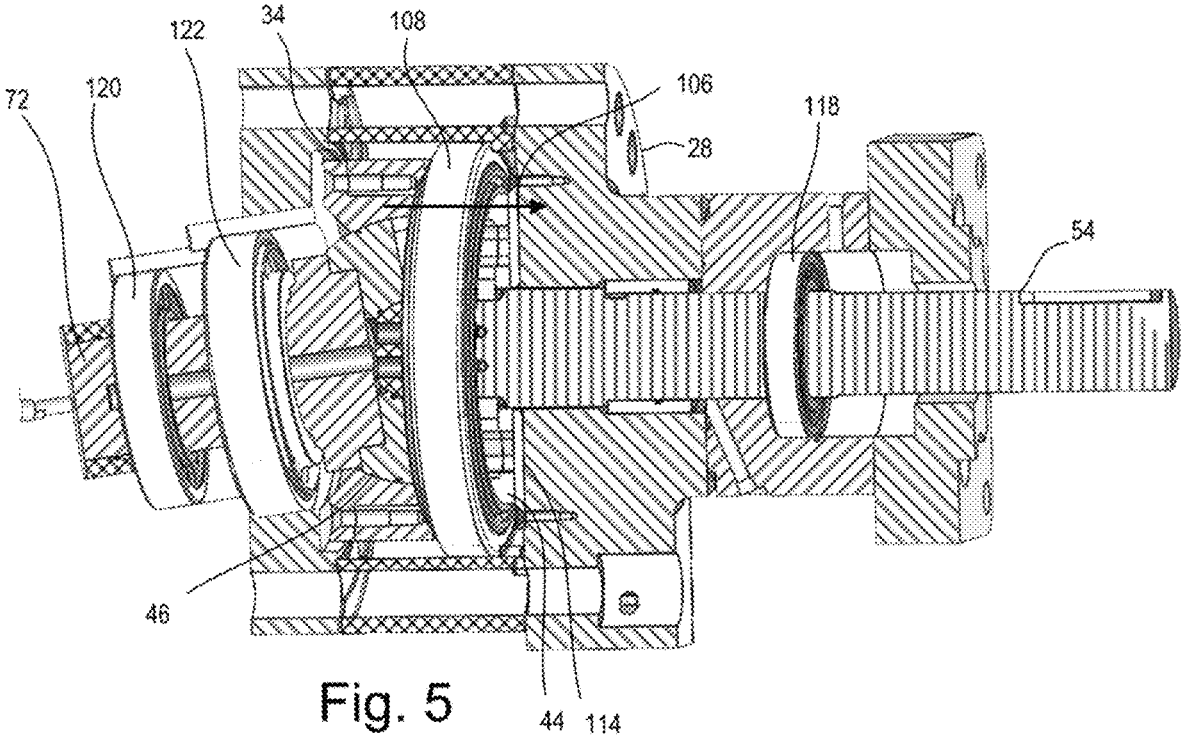
FIG. 5 is a side partial cutaway view of the apparatus shown in FIG. 1.

The example shown in FIG. 1 is arranged wherein the first shaft 54 of the pump 20 cooperates with an annular sealing ring 52 fitted around the first (drive) shaft 54. The annular sealing ring 52 of this example extends radially outward from the outer surface 57 of the first shaft 54. In this example, the sealing ring 52 extends radially into a radial recess 56 of the housing 22. In one example, the axial length of the recess 56 (measurement parallel to the axis of the first shaft 54) is greater than the axial length of the annular sealing ring 52, allowing for axial movement 64 (parallel to the axis 66) of the annular sealing ring within the recess 56. In this example, the annular sealing ring 52 comprises an O-ring groove 74 on the inner or outer (shown in the inner surface). This O-ring groove is configured to hold an O-ring for sealing the annular sealing ring 52 to the drive shaft 54. Line of action 106 in FIG. 5 illustrates the direction of force exerted on the first rotor running thru bearing 108 as pressure increases in the working chambers 58 (See. FIG. 2), pressing the rotors 44/46 away from each other.

In one example, a separate and cooperating annular sealing ring 76 is provided between the outer surface 78 of the second shaft 72 and an inner surface 80 of the housing 22. Similar to the previous example, in this example of the sealing ring 76, the axial length (parallel to axis 70) of the recess 77 in which the sealing ring 76 is positioned is greater than the axial length of the annular sealing ring 76. This arrangement allowing for axial movement (parallel to axis 70) of the annular sealing ring 76 within the recess 77. The annular sealing ring 76 optionally comprising an O-ring groove 82 configured to hold an O-ring on the inner or outer (shown in the inner surface). The O-ring configured to seal the annular sealing ring 76 to the outer surface 78 of the shaft 72. The annular sealing ring 76 is functionally similar to the annular sealing ring 52 previously described. Each of the rings 52/75 forming a fluid thrust bearing of the pressure balancing system 73.

Figure 6:
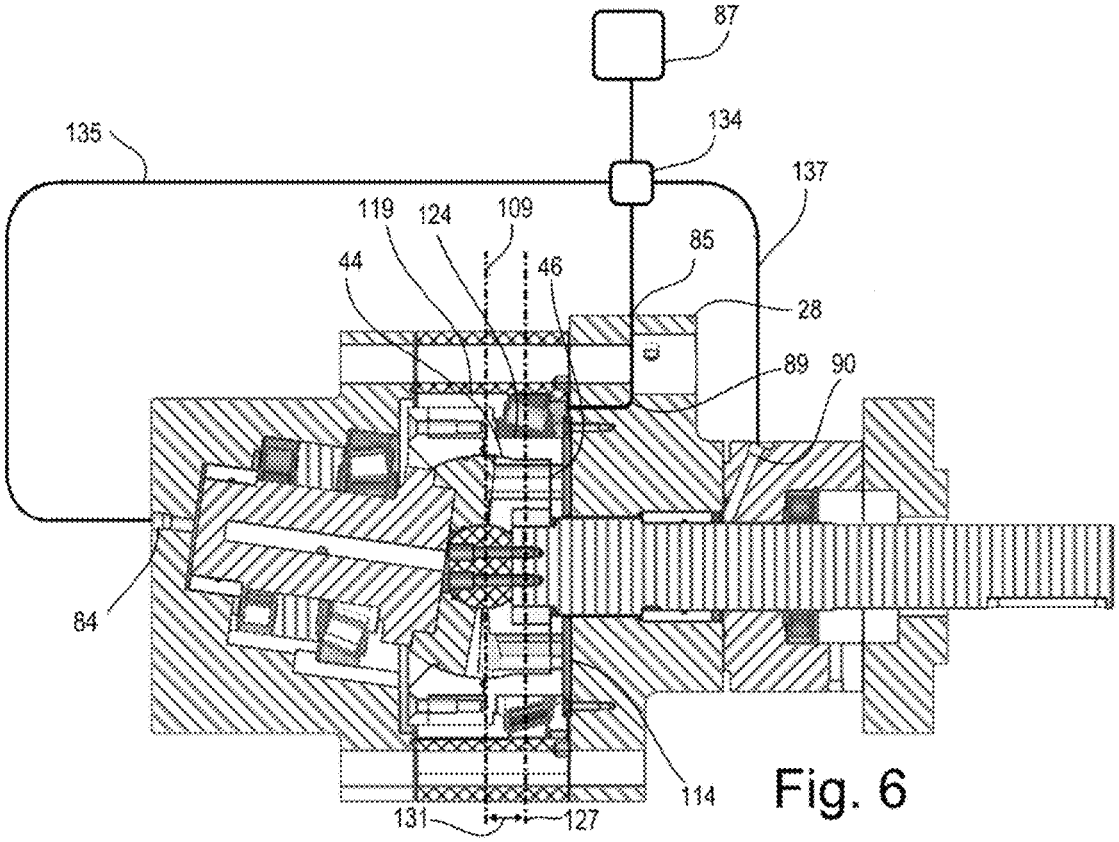
FIG. 6 is a cutaway view of the example shown in FIG. 1, Illustrating a highly schematic fluid flow path.

In one example, on the second rotor 46 side of the pump 20, high pressure fluid is conveyed via conduit 84 shown in FIG. 1 from a source 87 (See FIG. 6) of fluid under pressure to pressure chamber 86. The pressure chamber 86 biasing the annular sealing ring 72 toward the rotors 44/46 as pressure is increased in the pressure chamber 86. In one example, the inward end 92 of the annular sealing ring 72 presses against a radial extension 94 of the second shaft 72. This pressure biasing the second rotor 46 toward the first rotor 44 as pressure in the pressure chamber 86 increases. The high-pressure fluid (liquid or gas) then exerts force upon the annular sealing ring 72 and/or rear face 88 of the second shaft 72, offsetting the pressure within chamber 58. It is to be understood that the fluid conduit 84 shown in FIG. 6 is fluidly connected to the pump outlet 85 via fluid conduit 135 or other methods known by persons skilled in the art.

Figure 3:
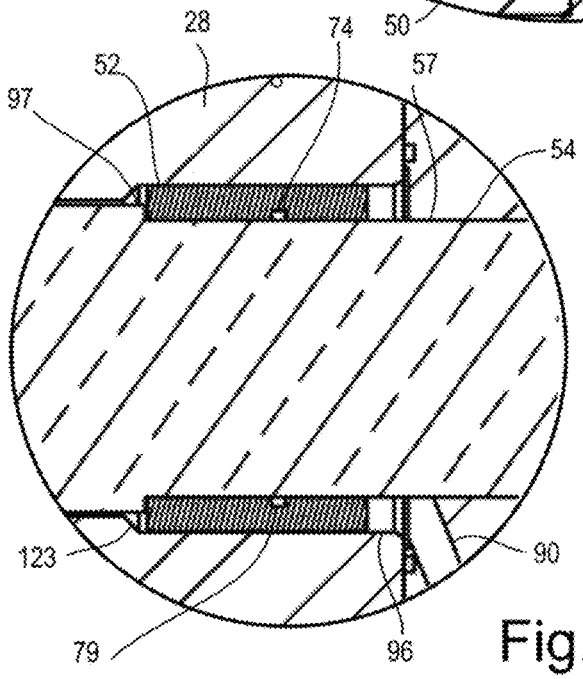
FIG. 3 is an enlarged view of the region 3 of FIG. 1.

Similarly, shown in FIG. 3, a fluid conduit 90 forming an inlet on the first rotor 44 side is configured to convey fluid under pressure to a pressure chamber 96. The pressure chamber 96 between a housing component 98 and the annular sealing ring 52. In one example, shown in FIG. 3 the pressure chamber 96 is comprised of inner surfaces of the outer housing component 28 and the radially outward surface 57 of the first shaft 54. Fluid under pressure within the pressure chamber 6 exerts pressure against the sealing ring 52 to press the sealing ring 52 against a radial extension 97 of the first shaft 54. In one example, the radial extension 97 may not be required particularly in examples where the annular ring 52 is connected to the first shaft 54 by other structures such as high enough friction from an interference fit. This pressure thus biasing the first rotor 44 toward the second rotor 46 in a dynamic manner in that fluid pressure may be increased or decreased to increase or decrease the pressure bias toward the opposing rotor.

In one example, shown in FIG. 1, additional seals 100 are provided to reduce or eliminate pressure loss and fluid leakage between the stationary housing components 28/98. In one example, the fluid conduit 90 is also connected to pump outlet 85 (FIG. 6) via fluid conduit 137 as will be described in some detail below.

A thrust load is created in the chamber(s) 58 between the rotors 44 and 46 during operation with pressurized fluids in the chamber (58). This pressure in the chamber(s) 58 is countered axially by the fluid pressure in chambers 86/96 as previously described. The pressurized fluid in chambers 86/96 creates force similar to a hydraulic piston. This force biases the faces of the rotors 44/46 towards each other dependent upon the pressure within chambers 86/96

Figure 4:
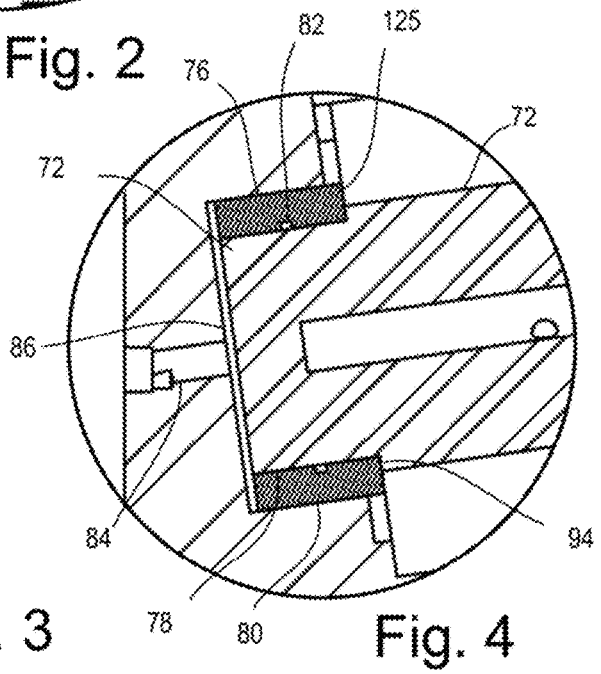
FIG. 4 is an enlarged view of the region 4 of FIG. 1.

Looking to the arrangement of the second rotor 46 shown in FIG. 1, the rear surface 88 of the second shaft 72 may form one surface of the pressure chamber 86. In such an arrangement, a relatively large surface area at the rear of the shaft 72 may be utilized. Thus, a relatively small fluid pressure may result in a rather large biasing force to press the rotor 46 towards the rotor 44. To increase efficiency, an annular ring or flange 76 may be used to increase the available pressure area and reduce fluid and pressure leakage where desired. The annular sealing ring 52 shown in FIG. 3 and annular sealing ring 76 shown in FIG. 4 reduce leakage and increase efficiency of the apparatus overall. In one example, a groove 79 with an O-ring therein may also be utilized equivalently to the component 74 previously described to reduce leakage and pressure loss.

The annular rings 52/76 in one example are sized to fit loosely on their respective shafts 54/72 respectively. Loosely meaning not press-fit, and the contacting faces may be sealed with an O-ring or equivalent component. This example is configured with axial tolerance to allow some motion between the shaft and the annular sealing ring due to shaft misalignment.

The radially outer surface 104 of the annular sealing ring 52 and/or sealing ring 76 in this example is close-fit to the corresponding bore (recess) 56/80 in the outer housing 22. The clearance between the housing recess 56/80 and the radially outward surface 104 of the annular ring 52 in one example allows a small flow of fluid (oil) to pass between the annular sealing ring 52/76 and the corresponding bore 56/80 for cooling and lubrication. In one example, a substantial volume of fluid passes between the annular rings 52/76 and the housing 22 to cool the adjacent surfaces. In one example, the fluid pressure is low that the amount of fluid flowing through between the annular sealing ring 52/76 and the bore 56/80 is negligible. This cooling/lubrication flow is not a significant portion of the total working fluid flow through the chambers 58. In practice, this fluid flow between the annular sealing ring 52/76 and the bore 56/80 can be as low as a drop (~0.05 ml) or two drops (~0.1 ml) per second, as the velocities and contact pressures at the interface between the annular rings 52/76 and the housing are relatively low.

Balancing the pumping loads within the chamber(s) 58 may be achieved be via porting through fluid conduits pressurized fluid from the pump outlet port 85 to the pressure chambers 86 and/or 96. On the second rotor shaft 72, the apparatus is configured that this fluid pressure to the pressure chamber 86 offsets the thrust pressure load from the pump rotors 44/46. In one example, the porting conduits are configured to result in zero or near zero load on the thrust bearing 122 supporting the second shaft 72.

Figure 7:
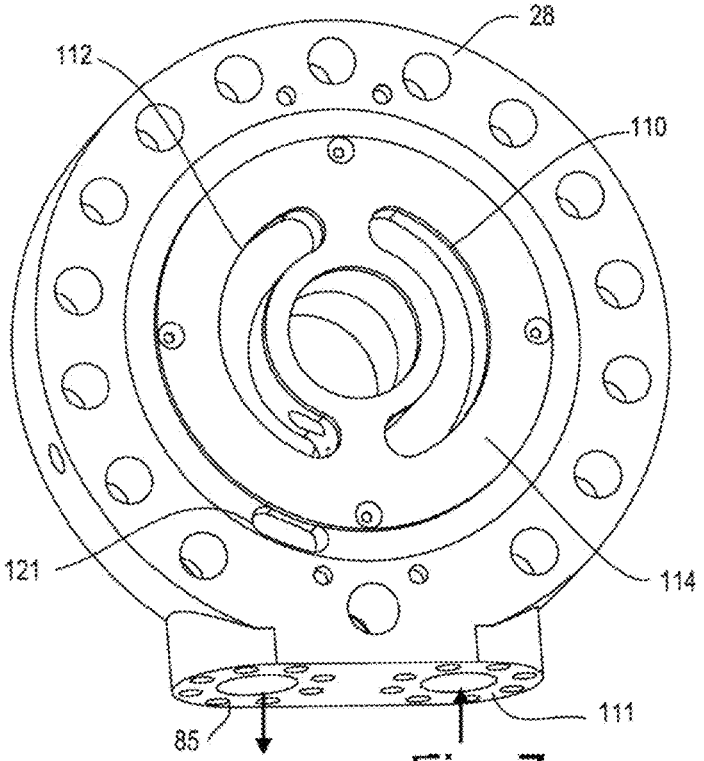
FIG. 7 is an end view of an outer housing component shown in FIG. 1.

FIG. 7 is an end view showing the center part of one example of the housing component 28. This housing component 28 comprising housing inlet/outlet ports 111, 85. Also shown is a sealing plate 114. In one example, this sealing plate 114 is positioned in close contact with the surface 115 of the rotor 44. In other examples, the sealing plate 114 is in close contact with the equivalent surface 115 of the inner housing 34 where an inner housing 34 is separate from the rotor 44. Where this sealing plate 114 comprises a gap 117 between the rear surface 115 of the rotor 44 and the housing body 28, the gap 117 forms a bushing seal. Using fluid pressure as a pressure balance allows the sealing plate 114 to act as a mechanical seal.

A mechanical seal is a device that helps join systems or mechanisms together and prevent leakage, contain pressure, or exclude contamination. The effectiveness of a mechanical seal is dependent on adhesion in the case of sealants and compression in the case of gaskets.

Figure 9:
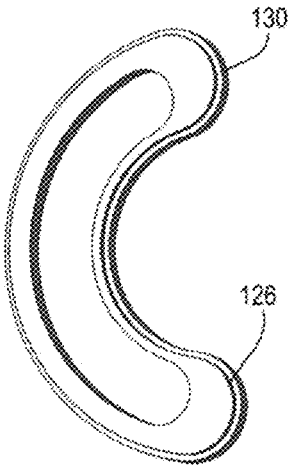
FIG. 9 is an enlarged view of one seal component shown in FIG. 8.
Figure 8:
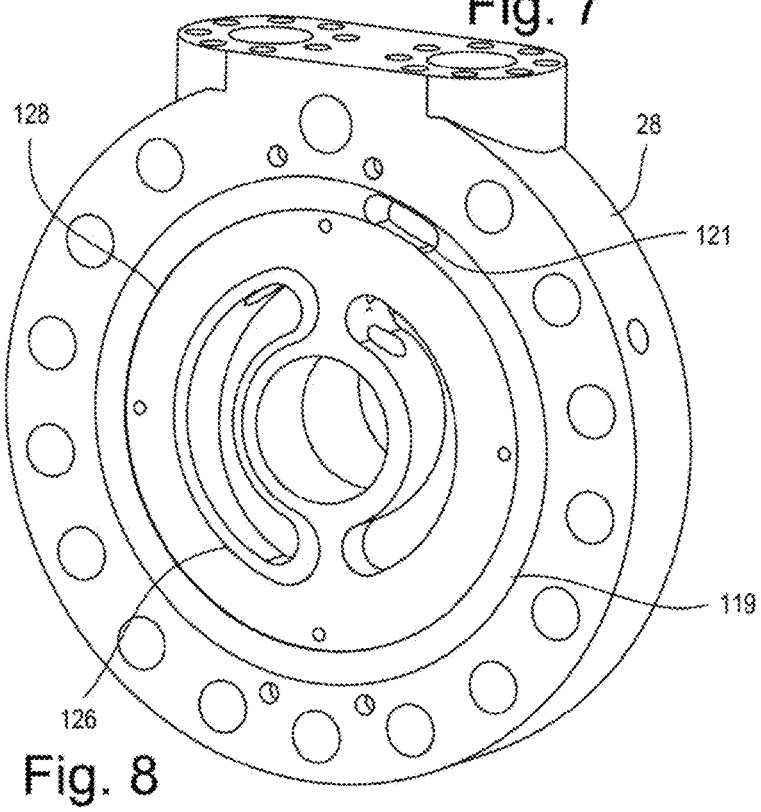
FIG. 8 is an end view of the outer housing component shown in FIG. 7 with a bushing seal.
Figure 10:
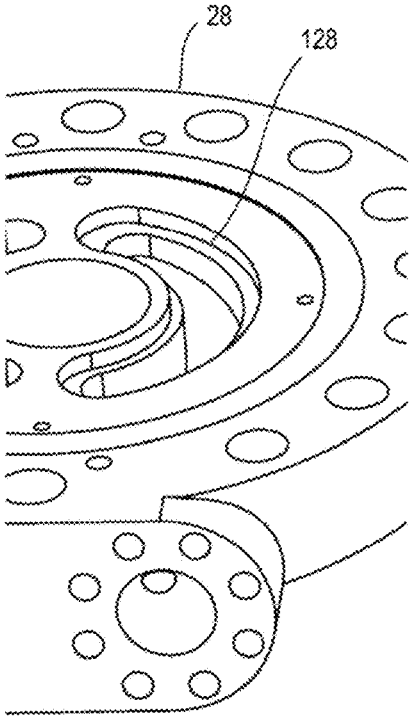
FIG. 10 is an enlarged view of a region of FIG. 8 with a rotor outlet seal removed to show the recess in which it may be placed.

In one example, leakage from the gap 117 between the rotor 44 and the housing body 28 can be minimized by sealing between the housing ports 110, 112 and the rear surface 115 of the rotor 44. Minimizing leakage via a seal can be accomplished with either a close gap/labyrinth seal, or a contact pressurized mechanical seal. The example shown in FIG. 8, FIG. 9 shows one such mechanical seal as an outlet port seal 126, positioned adjacent to or fit partially within a conforming recess 128 in the housing component 28. In one example, the outlet port seal 126 is positioned around the rotor outlet port 112 and may be pressed against the rear surface of the inner housing component 34 so as to form a seal thereto. An O-ring groove 130 may be provided on the outlet port seal 126. An O-ring positioned in the groove 130 forms a seal to the inner surface of the rotor outlet port 112 as the outlet port seal 126 repositions toward the rear surface 132 of the inner housing component 34. In one example this seal can be accomplished via a contact mechanical seal such as sealing plate 114, in one example the outlet seal 126 is also utilized. The outlet seal 126 may be pressurized from within the rotor outlet port 112 so as to bias toward the rear surface 132 of the inner housing component 34. As shown in FIG. 8, the seal 126 fits in the corresponding recess 128 shown more clearly in FIG. 10.

In examples where the rotor housing inlet port 110 and rotor housing outlet ports 112 (FIG. 7) are sealed with a narrow gap or other seal (e.g. sealing plate 114), the force exerted on the rear surface 115 of the first rotor 44 in one example is non-linear and a balancing force must be approximated if the "hydrodynamic effect" becomes substantial. As the dynamic film of the bearing fluid is pressed between the sealing plate 114 and the rear surface 115 of rotor 44, the local pressure of the fluid changes with variations in gap height. This is known as a "hydrodynamic effect". In examples where the bearing gap 117 (FIG. 2) between the sealing plate 114 and the rear surface 115 of rotor 44 is reduced, the local pressure of the fluid increases. Conversely, if the bearing gap 117 between the sealing plate 114 and the rear surface 115 of the rotor 44 is increased, the local pressure of the fluid decreases. If a pressure load at the chamber 58 causes a gap 117 to decrease, the reaction force that is caused from the "hydrodynamic effect" may be substantially opposite to the initial load. As this gap 117 becomes smaller, the reaction force may increase.

The hybrid bearing as disclosed herein in one example is configured that contact does not occur between the sealing plate 114 and rear surface 115 of rotor 44 during operation. Thus, the hydrodynamic effect formed between these two substantially concentric or parallel surfaces (between the sealing plate 114 and the rear surface 115 of rotor 44) with a substantial relative rotational velocity may be "self-compensating" in that the relative position or spacing between the components may not substantially change in the direction of applied loads where contact may otherwise occur. This compensation may be done without external methods of control and it may be enhanced at higher surface speeds and/or with higher viscosity working fluids. As the pressure between the sealing plate 114 and the rear surface 115 of rotor 44 increases, the uncompensated pressure upon the first shaft 54 creates an increasing force. Explained differently, the first shaft 54 in one example has ambient pressure acting on the faces 57 on the exterior of the pump whereas the pressures at the chamber 58 and other pump surfaces may be substantially higher than ambient pressure. The ambient pressure on an object is the pressure of the surrounding medium, such as a gas or liquid, in contact with the object. A relatively small pressure area is uncompensated. However, when as the chamber pressures increase, the net loads also increase. For this reason, thrust bearings 108 may be utilized on the shaft.

In another example, it may be possible to further reduce an unbalanced thrust load on the first rotor 44 using the methods and apparatus disclosed herein. In one example, balancing thrust loads may be accomplished by fluidly connecting a cavity 119 radially outward of the seal 114 to the pump outlet 85 via tubing/piping port 121 or other methods known by persons skilled in the art. One example of this is shown in FIG. 6 where conduit 89 fluidly connects the cavity 119 and the restrictor 134 and/or conduit 85. In one example, cavity 119 is formed between housing components 26/28/30/34 as thrust bearing 108 may not substantially seal pressure and flow from one side to another. The pressure at the cavity 119 may be substantially similar or different to the pressure at the pump outlet 85. This pressure differential or equivalence may be controlled via the fluid conduits including restrictors 134 therein. One such restrictor 134 comprises a pressure control-valve fluidly connected between the pump outlet 85 and the cavity 119. An increase of the pressure in cavity 119 may act to push the first rotor 44 towards the second rotor 46. This bias pressure may be compensated if the fluid pressure supplied to the second pressure chamber 123 labeled in FIG. 3 at the axially inboard side of the annular ring 52 may exceed the pressure at the first bearing chamber 96. To reduce an unbalanced thrust load on the second rotor 46, the pressure at a second pressure chamber 125 labeled in FIG. 4 at the axially extended side of annular ring 76 may exceed the pressure at the first bearing chamber 86.

In examples where no pressure compensating system (e.g. flanges 52/76) is used, the thrust loads on the shafts 54/72 can become prohibitively large when high pressures are applied within the chamber(s) 58. These pressure loads in some applications can prevent the ability to use conventional roller thrust bearings, or plain thrust bushings. A "plain bearing" is a sliding bearing that does not use any special hydrodynamic effects.

Moment load from rotor radial load may be eliminated by positioning bearings 108 (see FIG. 5) with capacity to resist radial loads at approximate center of radial load on the radially exterior surface of the shroud or inner housing 34. Radial loads are defined in this context as being perpendicular to the respective rotor axis. In one example, the radial load on the first rotor 44 is perpendicular to its axis 66, shown in FIG. 6 as line 109. The bearing 120 may be paired with a second radial bearing 122 to take up the moment generated by the radial load on the rotor 46.

The pump design disclosed herein in one example comprises the bearing 108 placed at approximately the center of action of the radial load from the first side of the pump. Previous iterations of this style of pump have either had a through shaft to eliminate the moment load caused by the radial load on the rotors or have had cantilevered rotors which necessitated large and widely spaced radial bearings to compensate for. U.S. Pat. No. 8,602,758 discloses a through shaft, and U.S. Pat. No. 9,777,729 discloses cantilevered type rotors. The bearing 108 may be a tapered roller bearing configured to take both thrust and radial loads. In some examples, radial loads may have more tendency to bend the shaft in comparison to the same magnitude thrust load. When a load is applied to the end of a cantilevered shaft such as shaft 54 with connected first rotor 46 at the end, the radial deflection at rotor 46 may be very sensitive to the axial distance to the next support location. It is to be understood that there is a radial portion of the load applied at line 109. Bearing 108 in one example is positioned close to the centerline 109 of the action of the radial load on the rotor 44 which is perpendicular to the shaft axis and passes very close to the center point of the rotor frusto-sphere. Line 127 shows a plane passing through the center of bearing 108 also orthogonal to the rotational axis of the rotor 44 and attached shaft. The (axial) distance 131 between these defining a moment arm. This is the largest radial load as it includes the radial loads generated by the inner housing 34. By placing a large diameter bearing 108 on the outside surface 124 of the inner housing 34, the first rotor 44 is thus not substantially cantilevered. In FIG. 6, the distance "131" between the location of the radial load at line 109 and the axial plane 127 of bearing 108 is minimized, which may reduce deflections considerably. This arrangement in some applications reduces or eliminates the need for large radial bearings on the shaft 54 or 72. This arrangement facilitates location of the pressure compensating annular rings 52/76 on the shafts 54/72 respectively. The shaft support bearing 118 of one example is configured to balance the moment on the shaft 54. In one example the bearing 118 is a shaft support bearing.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept. The invention illustratively disclosed herein suitably may be practiced in the absence of any element which is not specifically disclosed herein.

The invention claimed is:

1. A pressure balancing system comprising:

a housing;

a first rotor within the housing having a first axis of rotation, a first shaft, a first rotor face surface;

a second rotor having an axis of rotation, a second rotor face surface adjacent the first face surface of the first rotor;

the first rotor face surface, the second rotor face surface, and an inner surface of the housing forming at least one working fluid chamber;

a first annular ring fitted around the first shaft fixed to the first rotor;

the first annular ring adjacent a first pressure chamber;

the first pressure chamber comprising a first fluid conduit through the housing to a source of fluid under pressure; and the first annular ring configured to bias the first rotor toward the second rotor dependent upon fluid pressure within the first pressure chamber.

2. The pressure balancing system as recited in claim 1 further comprising a radial extension of the first shaft wherein the first fluid conduit is configured to convey fluid to the first pressure chamber between the housing and the annular ring to bias the annular ring against the radial extension of the first shaft thus biasing the first rotor toward the second rotor.

3. The pressure balancing system as recited in claim 1 wherein the first fluid conduit fluidly connects the first pressure chamber to an outlet of the at least one working fluid chamber.

4. The pressure balancing system as recited in claim 1 wherein the fluid conduit comprises at least one restrictor.

5. The pressure balancing system as recited in claim 4 wherein the restrictor comprises a valve.

6. The pressure balancing system as recited in claim 1 further comprising:

a second annular ring fitted around a second shaft fixed to the second rotor;

the second annular ring adjacent a second pressure chamber;

the second pressure chamber comprising a second fluid conduit through the housing to the source of fluid under pressure; and the second annular ring configured to bias the second rotor toward the first rotor dependent upon fluid pressure within the second pressure chamber.

7. The pressure balancing system as recited in claim 6 wherein the second fluid conduit fluidly connects the second pressure chamber to the outlet of the at least one working fluid chamber.

* * * * *